US007750794B2

(12) United States Patent
Rebsch

(10) Patent No.: US 7,750,794 B2
(45) Date of Patent: Jul. 6, 2010

(54) SAFETY ALARM FOR TRACTOR-TRAILERS

(76) Inventor: Glenn Rebsch, 1853 Joseph Ct., Cincinnati, OH (US) 45231

( * ) Notice: Subject to any disclaimer, the term of this patent is extended or adjusted under 35 U.S.C. 154(b) by 287 days.

(21) Appl. No.: 11/828,707

(22) Filed: Jul. 26, 2007

(65) Prior Publication Data

US 2009/0027178 A1 Jan. 29, 2009

(51) Int. Cl.
*G08B 21/00* (2006.01)

(52) U.S. Cl. ..... 340/431; 340/425.5; 340/438

(58) Field of Classification Search ..... 340/431, 340/425.5, 438, 687, 686.1, 932.2; 414/401
See application file for complete search history.

(56) References Cited

U.S. PATENT DOCUMENTS 3,217,291 A 11/1965 King
3,957,013 A 5/1976 Ignatjev
4,250,486 A 2/1981 Kiefer et al.
4,363,249 A 12/1982 Stugart
4,680,571 A 7/1987 Keklak et al.
4,692,755 A 9/1987 Hahn
4,843,373 A 6/1989 Trickle et al.
5,045,834 A * 9/1991 Hutchcraft ..... 340/436
5,453,735 A 9/1995 Hahn
6,318,947 B1 11/2001 Hahn et al.
6,634,139 B1 10/2003 Metz
6,781,516 B2 8/2004 Reynard et al.
6,812,849 B1 11/2004 Ancel
7,339,473 B2 * 3/2008 Lucas ..... 340/545.1
2005/0028723 A1 2/2005 Ancel
2005/0226705 A1 10/2005 Wilson

* cited by examiner

*Primary Examiner*—Brent Swarthout
(74) *Attorney, Agent, or Firm*—Wood, Herron & Evans, L.L.P.

(57) ABSTRACT

An alarm system for use with unloading tractor-trailers includes an alarm that is physically located within the tractor-trailer and connected to a fixed structure located outside the tractor-trailer. If the tractor-trailer inadvertently pulls away from the loading dock while a forklift driver is in the trailer, the alarm will go off inside the trailer making the forklift driver aware of the movement of the trailer.

12 Claims, 3 Drawing Sheets

SAFETY ALARM FOR TRACTOR-TRAILERS

BACKGROUND OF THE INVENTION

Cargo in tractor-trailers is frequently unloaded by backing the trailer up against a loading dock. A forklift is then used to transport the product from inside the trailer to the loading dock and storage area. This requires the forklift to enter the trailer repeatedly. It is possible, for various reasons, for the trailer to move away from the loading dock while the forklift and forklift driver are in the trailer. Due to noise and vibration caused by the forklift, this may not be apparent. If the forklift driver than backs out of the trailer, which has moved away from the loading dock, the forklift will fall several feet, which can cause severe injury or death.

There are various alarm systems that can be used to warn individuals if a trailer is inadvertently pulled away from a loading dock. Such systems generally employ an alarm that is located on the loading dock. Such systems are problematic because they require that the system be properly attached to the truck. A forklift driver, once inside the trailer, has no way of knowing or verifying that the alarm system has been properly attached to the trailer. Further, even if the device is properly attached, an alarm outside the trailer may not be heard by the forklift operator. The inside of the trailer reverberates with the sound of the forklift, and, thus, can drown out the sound of an alarm that is located outside the trailer.

SUMMARY OF THE INVENTION

The present invention is premised on the realization that an alarm system that incorporates an alarm physically located within the trailer will provide a level of safety not provided by prior art alarms. Such a device, when located inside the trailer and attached to, for example, the loading dock by a cord or the like, will provide an alarm inside the trailer, which the forklift driver must hear. This can also be associated with a light signal, so that the forklift driver also sees a warning. The device of the present invention is beneficial in that the forklift driver can see that the device is in the truck and, thus, properly activated at all times, thereby providing an added level of security for the forklift driver. A test button can also be provided that will allow the fork lift driver to test the alarm to make sure that it is properly functioning.

The objects and advantages of the present invention will be further appreciated in light of the following detailed description and drawings in which:

DETAILED DESCRIPTION

Figure 1:
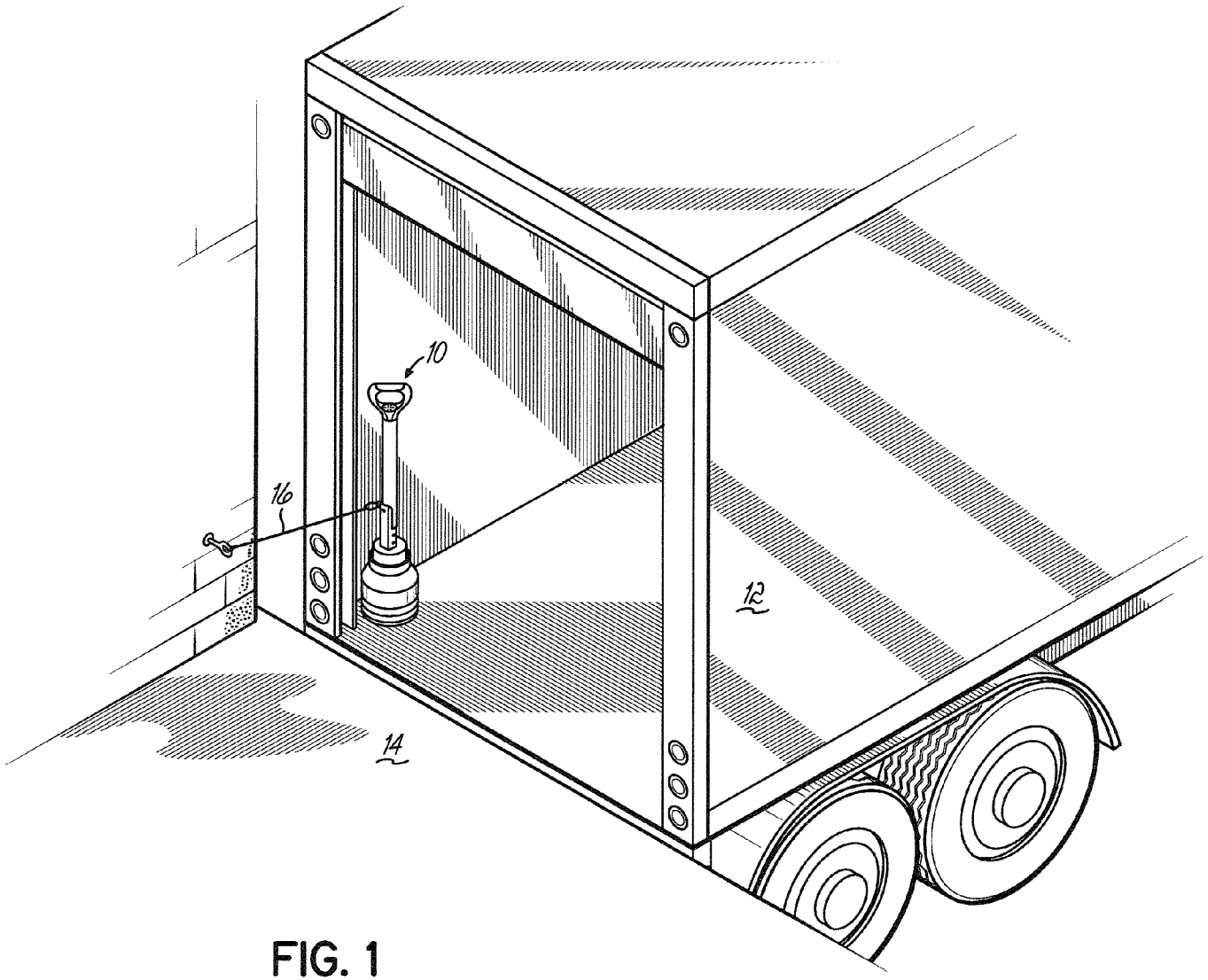
FIG. 1 is a perspective view partially broken away of the alarm system of the present invention located within a trailer.

As shown in FIG. 1, the alarm system of the present invention includes an alarm 10 which is located on the bed of a trailer 12 which is located at a loading dock structure 14. A cord 16 connects a magnetic switch 18 on the alarm 10 to a fixed structure, preferably a structure on the loading dock 14.

Thus, in operation, when the trailer 12 moves away from the loading dock, the cord 16 will be stretched out and pull the magnetic switch 18, causing the alarm 10 to go off.

More particularly, the alarm 10 includes an enlarged base 22 having an upwardly extending cylindrical stem 24 extending to a handle 26. The base 22 includes a lower most weighted portion 30, which is generally a series of iron weights, or the like, and a bottom 32, which is a permanent magnet.

Figure 3:
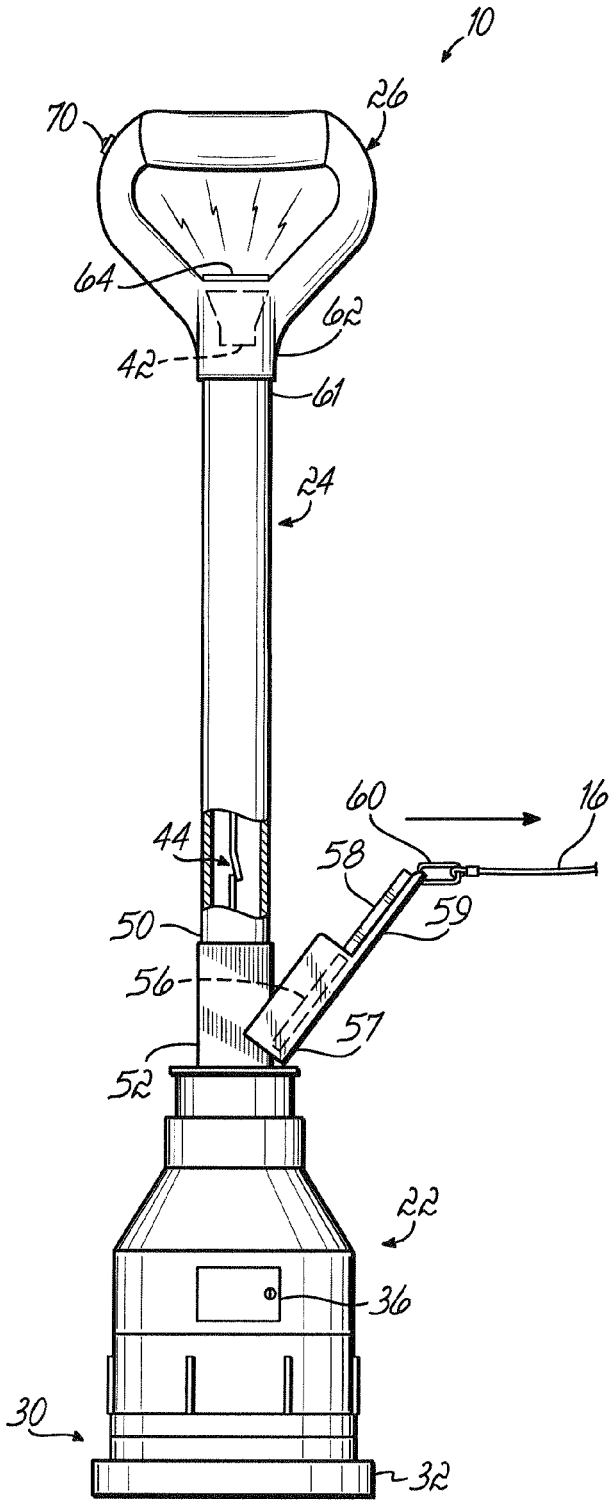
FIG. 3 is an elevation view partially broken away similar to FIG. 2.
Figure 5:
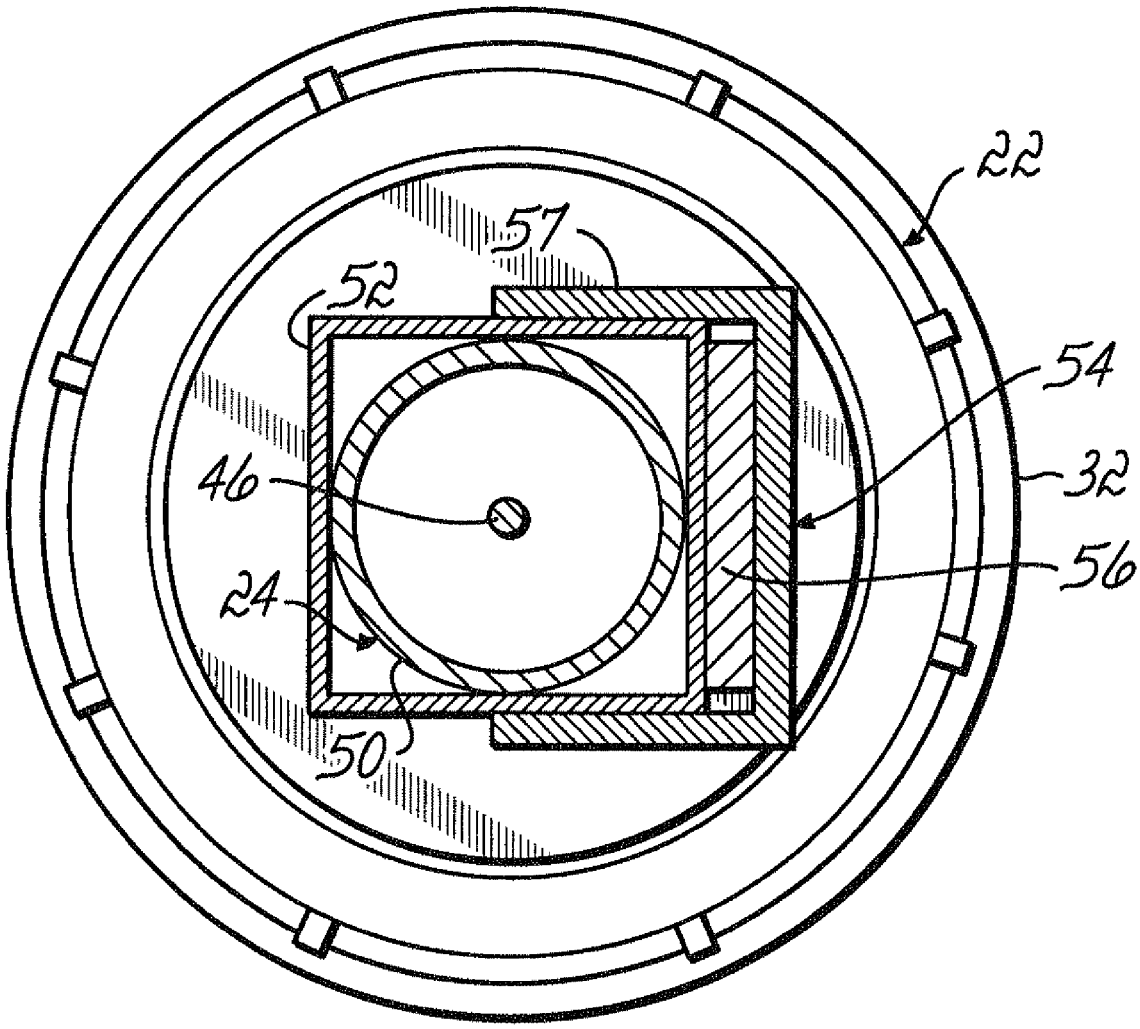
FIG. 5 is a cross sectional view taken of lines 5-5 of FIG. 1.

Located inside the base 22 is a battery compartment 36 housing a battery 38. Located at the top of stem 24 is a signal generator 42, shown in phantom, which, as shown, is a noise-generating device. As shown in FIG. 3, connecting the battery 38 to the signal generator are first, second and third switches 44, 46 and 47.

These switches, as described below, will normally be in an open position. When any of these switches is closed, current will be directed to the signal generator 42 causing the audible or visual signal.

Figure 2:
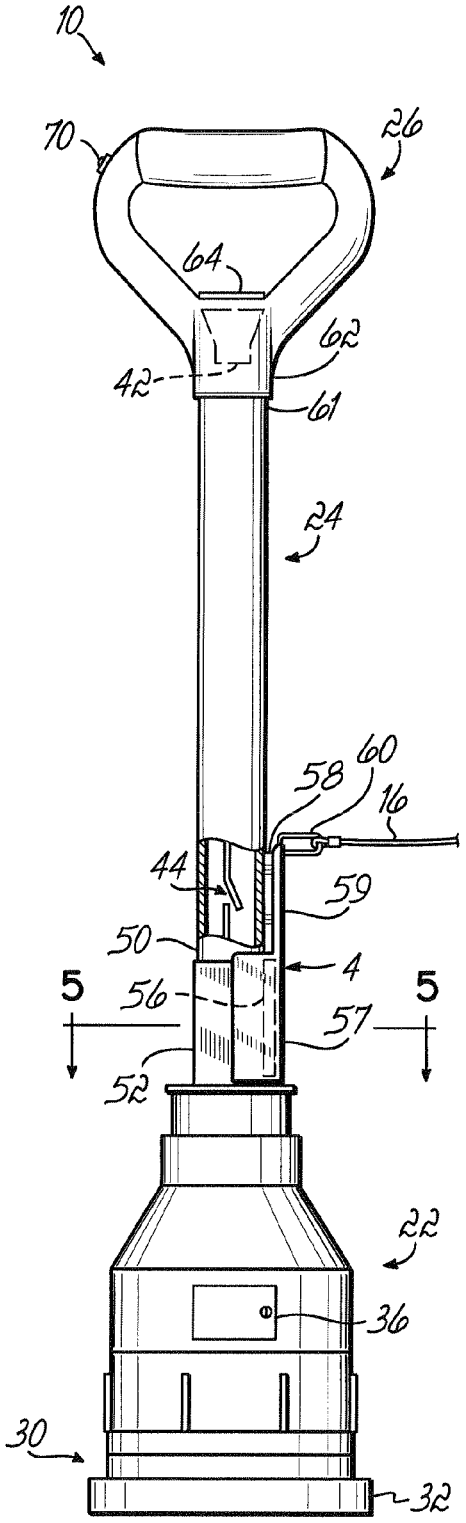
FIG. 2 is an elevation view partially broken away of the alarm for use in the present invention.

The first switch 44 is located in the base 50 of stem 24. The base 50 of stem 24 is surrounded by a square metal collar 52. First switch 44 is located inside stem 24 immediately above the metal collar 52. A U-shaped switch member 54 is fixed to the metal collar 52 held in place by a first magnet 56 with a portion 57 of the U-shaped member engaging the sides of collar 52. An upper portion 59 of the U-shaped member 54 extends above the collar 52 and aligns with the first switch 44. Attached to the upper portion 59 is an upper magnet 58. Switch 44 is biased in a closed position. Upper magnet 58 is designed to maintain the first switch in an open position, as shown in FIG. 2. Absent magnet 58, the first switch 44 would close, as shown in FIG. 3, allowing current to flow. Cord 16 is attached via a connector 60 to the upper portion 59 of U-shaped member 54.

As indicated previously, the handle 26 is attached to an upper portion 61 of stem 24. The base 62 of handle 26 includes a screened opening 64 aligned immediately above the signal generator or noise generator 42.

The alarm 10 includes a spring-biased button 70 for activating second switch 46, which permits an individual to determine if the alarm is operating properly. Also located in stem 24 is a tilt switch 47.

Figure 4:
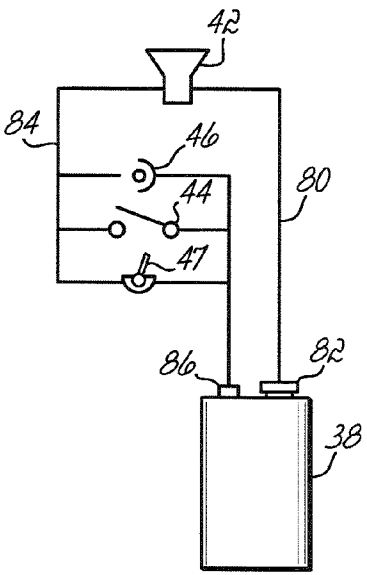
FIG. 4 is a diagrammatic depiction of the electrical wiring of the alarm for use in the present invention.

As shown in FIG. 4, the signal generator or alarm 42 is operated by direct current having a first wire 80 connected to a first pole 82 of battery 38. Battery 38 can be a 9-volt battery or any battery effective to activate the alarm 42. A second wire 84 of alarm 42 connects to the three normally open switches 46, 44, and 47. As indicated below, closing any of these switches will complete the circuit to pole 86 of battery 38 causing the alarm 42 to sound. A low battery indicator or alarm can also be employed if desired.

To use the alarm of the present invention, the alarm 10 is positioned inside the trailer 12 of a truck or a truck bed that is adjacent, for example, a loading dock 14. If the truck bed is ferromagnetic, the magnet 32 will hold the alarm 10 in position. If the bed is wood or aluminum, or other non-ferromagnetic material, the mass of weights 30 are designed to provide sufficient resistance to hold the alarm 10 in position. The U-shaped switch member 54 is located over the square collar 52 so that upper magnet 58 is aligned with first switch 44, maintaining it in an open position, as shown in FIG. 2. Likewise, second, or test, switch 46 is in an open position. The cord 16, which is attached to the U-shaped switch member 54 at one end, is then tied at the opposite end to a fixed structure outside the trailer 12. This can be a portion of the loading dock, or the wall, or other structure, as desired. The cord 16 should be relatively taut, and, certainly, should not have enough slack to allow the trailer to move away from the loading dock without setting off the alarm.

When placing the alarm 10 in the trailer, the operator can press test switch 46 and set off the alarm to determine if the alarm is working. The trailer 12 can then be unloaded by the forklift operator. In the event the trailer moves away while the forklift is in the trailer, the cord 16 will pull the U-shaped switch member 54 separating it from the collar 52, as shown in FIG. 3, pulling the second magnet 58 away from switch 44 causing the switch to close. This will, in turn, activate the signal device 42, which will inform the forklift driver that the trailer 12 has moved away from the loading dock 14. After the trailer 12 is safely unloaded, the alarm 10 is removed from the trailer. If the alarm 10 is knocked over for any reason, tilt switch 47 will close, also activating the alarm.

If desired, the alarm 42 can also comprise a flashing light. Any alarm device that would affectively alert a forklift driver can be used in the present invention. Further, other types of switches can be employed in place of magnetic switch 44 as long as the switch closes in response to cord 16 being pulled.

Using the alarm 10 provides several advantages. Most importantly, it creates the alarm inside the trailer where it is most easily noticed by the forklift operator. Further, the forklift operator will appreciate that the alarm is in position because he can see the alarm in position. Finally, if necessary, he can test it to make certain that the battery is operating. This provides not only a sense of security, but added security for the forklift operator.

This has been a description of the present invention along with the preferred method of practicing the present invention. However, the invention itself should only be defined by the appended claims, Wherein I claim:

1. An alarm system comprising an alarm having a switch which activates a signal said alarm positioned in a housing and said alarm system positioned in a movable structure which is one of a truck bed or the inside of a trailer of a tractor trailer said alarm system having a switch member attached to said alarm wherein said alarm is activated by the separation of the switch member from said alarm system by movement of a portion of the housing away from a main component of the housing;

said switch operatively connected to a fixed structure separate from said movable structure by a cord fixed at one end to said fixed structure and a second end fixed to said switch member;

wherein movement of said movable structure relative to said fixed structure separates said switch member from said main component of the housing which closes said switch in turn activating said signal within said movable structure and generating said signal from within said movable structure while said alarm remains in said movable structure; and wherein said alarm system includes at least one of (a) sufficient mass to prevent said alarm from being moved when said switch member is pulled from said alarm, or (b) a magnet adapted to fix said alarm system to said movable structure .

2. The alarm system claimed in claim 1 wherein said movable structure is a trailer.

3. The alarm system claimed in claim 1 wherein said movable structure is a truck.

4. The alarm system claimed in claim 1 wherein said switch is magnetically activated.

5. The alarm system claimed in claim 1 wherein said alarm includes a mass sufficient to prevent movement of said alarm when said switch is activated.

6. The alarm system claimed in claim 1 wherein said fixed structure is part of a loading dock.

7. The alarm system claimed in claim 1 wherein said alarm is battery operated.

8. The alarm system claimed in claim 1 further including a magnetic base.

9. A movable alarm in an alarm system for use in a trailer comprising;

a battery powered signal generator;

said alarm mounted in a housing having a switch member attached to said alarm system wherein said alarm is activated by the separation of the switch member from said system by movement of a portion of the housing away from a main component of the housing;

a switch connecting said signal generator with said battery;

a cord connected to said switch member and adapted to connect to a fixed structure outside said trailer when said alarm is located within said trailer;

wherein said alarm includes at least one of (a) sufficient mass to prevent said alarm from being moved when said switch member is pulled from said alarm, or (b) a magnet adapted to fix said alarm to said movable structure; and wherein pulling said cord relative to said alarm separates said switch member from said alarm system which activates said alarm.

10. The alarm claimed in claim 9 wherein said switch includes a magnet separable from said alarm which activates said signal generator.

11. The alarm claimed in claim 10 wherein said signal is audible and visible.

12. The alarm claimed in claim 10 wherein said switch is proximal said base.

* * * * *